US009074276B2

(12) United States Patent
Kanai et al.

(10) Patent No.: US 9,074,276 B2
(45) Date of Patent: Jul. 7, 2015

(54) THERMALLY SPRAYED FILM FORMING METHOD AND DEVICE

(75) Inventors: Koichi Kanai, Yokohama (JP); Eiji Shiotani, Kawasaki (JP); Takashi Sekikawa, Yokohama (JP); Kimio Nishimura, Yokohama (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 803 days.

(21) Appl. No.: 12/180,153

(22) Filed: Jul. 25, 2008

(65) Prior Publication Data

US 2009/0029060 A1 Jan. 29, 2009

(30) Foreign Application Priority Data

Jul. 27, 2007 (JP) ..... 2007-195963
Apr. 15, 2008 (JP) ..... 2008-105477

(51) Int. Cl.

| | |
|---|---|
| ***C23C 4/18*** | (2006.01) |
| ***C23C 4/12*** | (2006.01) |
| ***C23C 4/02*** | (2006.01) |
| ***H05H 1/24*** | (2006.01) |

(52) U.S. Cl.

CPC ... *C23C 4/12* (2013.01); *C23C 4/02* (2013.01); *C23C 4/18* (2013.01); *H05H 1/24* (2013.01)

(58) Field of Classification Search

CPC ..... C23C 4/18
USPC ..... 427/446
See application file for complete search history.

(56) References Cited

U.S. PATENT DOCUMENTS

| | | | | |
|---|---|---|---|---|
| 4,160,048 | A * | 7/1979 | Jaeger | 427/455 |
| 4,460,529 | A * | 7/1984 | Schultze et al. | 264/81 |
| 5,080,056 | A * | 1/1992 | Kramer et al. | 123/193.4 |
| 5,271,967 | A * | 12/1993 | Kramer et al. | 427/455 |
| 5,922,412 | A * | 7/1999 | Baughman et al. | 427/449 |
| 6,622,685 | B2 | 9/2003 | Takahashi et al. | |
| 2003/0056520 | A1 * | 3/2003 | Campbell et al. | 60/777 |
| 2005/0137829 | A1 * | 6/2005 | Gimelfarb et al. | 702/171 |

FOREIGN PATENT DOCUMENTS

| | | | |
|---|---|---|---|
| DE | 41 24 423 | A1 * | 2/1992 |
| JP | 07-062518 | * | 3/1995 |
| JP | 11-050225 | | 2/1999 |
| JP | 05-214505 | | 8/1999 |
| JP | 2002-155350 | | 5/2002 |
| JP | 2003-171754 | | 6/2003 |
| JP | 2006-083456 | | 3/2006 |

OTHER PUBLICATIONS

Clare, et al "Thermal Spray Coatings", Metals Handbook Ninth Edition, vol. 5: Surface Cleaning, Finishing, and Coating, American Society for Metals, 1982, pp. 361, 368.*

ASM International, "Introduction to Thermal Spray Processing", Handbook of Thermal Spray Technology, 2004, pp. 3-4.*

* cited by examiner

*Primary Examiner* — Katherine A Bareford
(74) *Attorney, Agent, or Firm* — Young Basile

(57) ABSTRACT

An apparatus is provided to reduce the defect rate and decrease production yield by removing foreign objects even when the foreign objects are mixed in with the thermally sprayed film. The operation for forming thermally sprayed film on inner surface of cylinder bore is paused, and protrusions generated in the thermally sprayed film by foreign objects are detected by visual observation and removed by a manual operation. The thermal spraying operation is then performed until thermally sprayed film reaches the prescribed film thickness. After formation of the thermally sprayed film, a finishing operation is performed by means of honing.

10 Claims, 11 Drawing Sheets

THERMALLY SPRAYED FILM FORMING METHOD AND DEVICE

CROSS-REFERENCE TO RELATED APPLICATIONS

This application claims priority from Japanese Patent Application Serial No. 2007-195963 filed Jul. 27, 2007 and Japanese Patent Application Serial No. 2008-105477 filed Apr. 15, 2008, each of which is incorporated herein by reference in its entirety.

TECHNICAL FIELD

The present invention pertains to a thermally sprayed film forming method and a thermally sprayed film forming device for forming a thermally sprayed film on the surface of a workpiece.

BACKGROUND

From the standpoint of improving the output power, mileage, and exhaust gas performance or the reduction of size and weight of internal combustion engines, there is a very high demand for designs having cylinder liners in the cylinder bores of an aluminum cylinder block, and as a substitute technology, progress has been made in thermal spraying technology for forming a thermally sprayed film made of a ferrous material on the aluminum cylinder bore inner surface.

Japanese Publication Patent Application (Kokai) No. 2002-155350 discloses a technology in which, in order to increase the degree of adhesion of the thermally sprayed film, a rough surface is formed by pre-processing the cylinder bore inner surface to create embossed threads.

BRIEF SUMMARY

Embodiments of a thermally sprayed film forming method and device are taught herein. One example of such a method includes forming the thermally sprayed film on a surface of a workpiece by spraying a molten material toward the surface of the workpiece and allowing the molten material to solidify on the surface and removing foreign objects mixed in with the thermally sprayed film before the surface of the thermally sprayed film is finished-processed.

Details of this method and others, and details of various embodiments of a thermally sprayed film forming device are described hereinafter.

BRIEF DESCRIPTION OF THE DRAWINGS

The description herein makes reference to the accompanying drawings wherein like reference numerals refer to like parts throughout the several views, and wherein:

FIGS. 1A-C illustrate the operation of the thermally sprayed film forming method in a first embodiment of the invention wherein FIG. 1A shows the state of formation of protrusions in the thermally sprayed film; FIG. 1B shows the state of thermal spraying performed after removal of the protrusions; and FIG. 1C shows the state of finishing the formed thermally sprayed film to the prescribed film thickness;

DETAILED DESCRIPTION OF EMBODIMENTS OF THE INVENTION

In order to adapt the technology for forming the thermally sprayed film to mass production of the cylinder bore portion of the product, it is necessary to guarantee quality and yield identical to those of existing products having a cylinder liner. In particular, there is the issue in production technology of improving mass production by increasing the yield by reducing the processing loss rate.

Thermal spraying technology is a means for obtaining a desired film thickness by layering plural porous films. Consequently, protrusions are unavoidably generated in the film layers, with nuclei consisting of foreign objects (dust from the preceding process steps, debris of films generated in the current process step, sputtered pieces, etc.) becoming attached to the thermal spraying substrate or being mixed in during the thermal spraying processing. The protrusions fall off during finish operations (honing, polishing, etc.) when the workpiece is finished to produce the shape of the cylinder bore in the operation subsequent to thermal spraying, and these cause the formation of the rough depressions (pits) in the bore surface corresponding to the pits in cylinder liners made of cast iron.

If many large pits are present, the following problems arise leading to deterioration in the commercial value: (1) because the volume of oil retained is increased, the oil consumption increases, leading to deterioration in engine performance; (2) because the sealing properties of the piston ring deteriorate, blow-by gas leaks as spray, leading to deterioration in engine performance; (3) due to catching when the piston ring slides, the thermally sprayed film separates, leading to deterioration in engine performance.

However, eliminating the generation of foreign objects themselves as the source of the defects is difficult to achieve in the manufacturing operation, and measures to address generation sources are insufficient. Also, finding pit defects during finish processing after thermal spraying leads to the generation of defective products, and this leads to significant deterioration in the yield.

In the above described technology to increase the degree of mechanism of the thermally sprayed film as previously proposed in Japanese Patent Application (Kokai) No. 2002-

155340, a rough surface is formed by pre-processing the cylinder bore inner surface to create embossed threads.

In contrast, embodiments of the invention provide a method and device so that when foreign objects become mixed in with the thermally sprayed film layer, it is still possible to remove the foreign objects in order to reduce the defect rate and increase the yield.

Figure 1C:
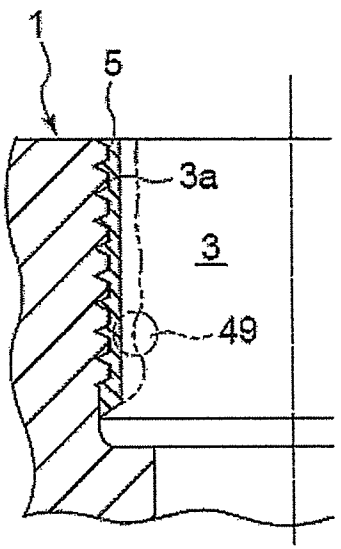
Figure 1B:
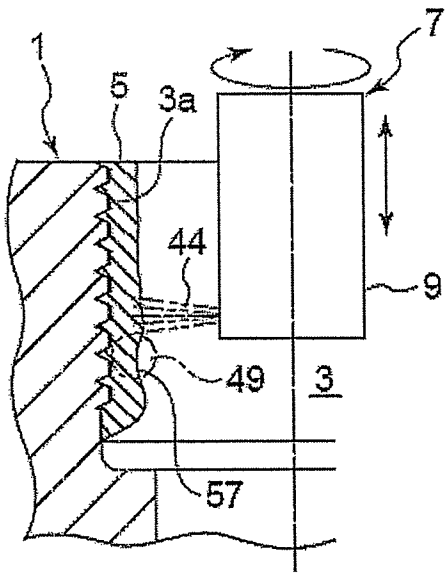
Figure 1A:
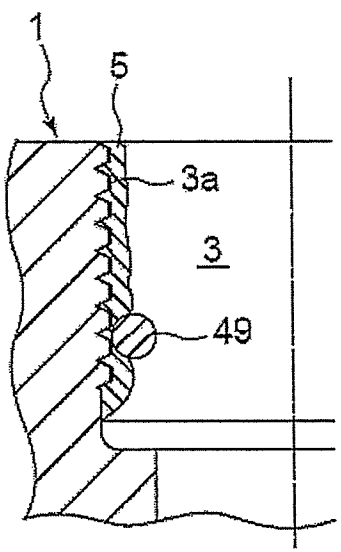

In the following, embodiments of the invention are explained with reference to the figures. FIGS. 1A, 1B and 1C are schematic diagrams illustrating the operations in the thermally sprayed film forming method in a first embodiment of the invention. As shown in the figures, thermally sprayed film 5 is formed on the workpiece consisting of inner surface 3*a* of cylinder bore 3 in cylinder block 1 of an engine.

Figure 2:
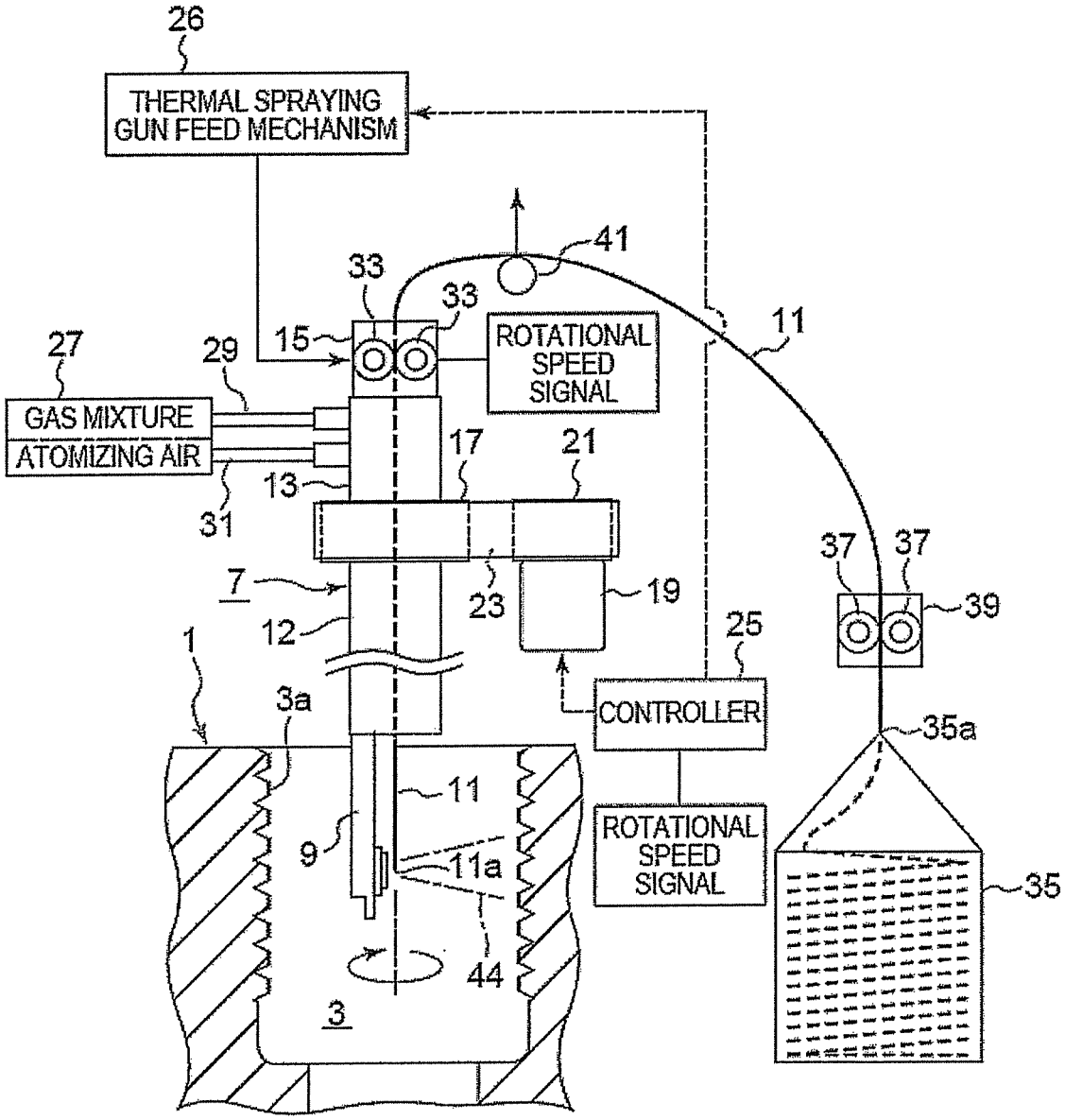
FIG. 2 is a diagram illustrating the overall assembly of a thermally sprayed film forming device.

For example, thermally sprayed film 5 is formed using the thermal spraying device shown in FIG. 2. In this thermally sprayed film forming device, thermal spraying gun 7 has thermal spraying nozzle 9 corresponding to the lower tip end in FIG. 2. In this thermal spraying gun 7, wire 11 made of a ferrous thermal spraying material is introduced from the upper end shown in FIG. 2, and it is fed to thermal spraying nozzle 9.

Starting from the end of thermal spraying nozzle 9, thermal spraying gum 7 comprises rotating part 12, gas supply pipe connecting part 13, and wire feeding part 15. Slave pulley 17 is arranged on the outer periphery near gas supply pipe connecting part 13. On the other hand, driving pulley 21 is connected to rotary drive motor 19. Pulleys 17, 21 are connected to each other by belt 23. Rotary drive motor 19 is driven under the control of controller 25 while it receives input of the prescribed rotational speed signal, and rotary drive motor 19 drives rotating part 12 to rotate together with thermal spraying nozzle 9 at its tip.

Controller 25 includes a microprocessor or numerical control unit, memory and inputs and outputs. The functions described herein are generally performed by software operating using the microprocessor and can be implemented in whole or in part using separate hardware components.

Rotating part 12 and thermal spraying nozzle 9 are rotated around wire 11 in thermal spraying gun 7 as the central axis. In this case wire 11 does not rotate.

This thermally sprayed film forming device includes thermal spraying gun feed mechanism 26 for making thermal spraying gun 7 perform up/down reciprocal movements in cylinder bore 3 in the state shown in FIG. 2. Thermal spraying gun feed mechanism 26 may have a structure wherein a pinion is driven to rotate by a motor and the rotating pinion is engaged with a rack mounted on the side of thermal spraying gun 7. In this case, thermal spraying gun 7 is driven to move up/down as shown in FIG. 2 along a guide part (not shown). Thermal spraying gun feed mechanism 26 is driven to move under the control of controller 25.

Connected to gas supply pipe connecting part 13 are gas mixture pipe 29 that feeds a gas mixture of hydrogen and argon from gas supply source 27 and atomizing air pipe 31 that feeds the atomizing air (air). The gas mixture fed from gas mixture pipe 29 into gas supply pipe connecting part 13 passes through the gas mixture passage (not shown in the figure) formed in rotating part 12 to thermal spraying nozzle 9. Similarly, the atomizing air fed into gas supply pipe connecting part 13 by atomizing air pipe 31 passes through the atomizing air passage (not shown in the figure) formed in rotating part 12 below connecting part 13 and is fed to thermal spraying nozzle 9.

Here, the gas mixture passage and the atomizing air passage (not shown in the figure) in gas supply pipe connecting part 13 should be respectively connected to the gas mixture passage and atomizing air passage (not shown in the figure) in rotating part 12 that rotates with respect to gas supply pipe connecting part 13. As the connecting structure in this case, for example, the lower end portions of the gas mixture passage and atomizing air passage in gas supply pipe connecting part 13 are formed as annular passages, and the upper ends of the gas mixture passage and atomizing air passage extending vertically in rotating part 12 are connected to these annular passages. As a result, even when rotating part 12 is rotated with respect to gas supply pipe connecting part 13, the gas mixture passage and atomizing air passage in rotating part 12 and the gas mixture passage and atomizing air passage in gas supply pipe connecting part 13 are respectively connected to each other at all times.

Wire feeding part 15 has a pair of feed rollers 33 that receive input of the prescribed rotational speed signal and are rotated so that they sequentially feed wire 11 towards thermal spraying nozzle 9. Here, wire 11 is accommodated in wire storage container 35. Wire 11 pulled out of outlet 35*a* in the upper portion of wire storage container 35 is fed by container-side wire feeding part 39, equipped with a pair of feed rollers 37, via guide roller 41 to thermal spraying gun 7.

Inside thermal spraying nozzle 9 is a cathode electrode (not shown). While a voltage is applied between the cathode electrode and tip 11*a* of wire 11, the gas mixture fed from gas supply source 27 to thermal spraying gun 7 is released from the gas mixture release port, so that the arc that is generated ignites the gas to melt tip 11*a* of wire 11 by the heat of the arc.

In this case, while wire 11 is melting it is sequentially fed forward as container-side wire feeding part 39 and wire feeding part 15 are driven. In conjunction with this, the atomizing air fed from gas supply source 27 to thermal spraying gun 7 is released in the vicinity of tip 11*a* of wire 11 from an opening near the gas mixture release port. The wire 11 melt, that is, the molten material, is driven to move forward as a spray 44 and becomes attached and then solidifies. As a result, thermally sprayed film 5 is formed on inner surface 3*a* of cylinder bore 3 as shown in FIGS. 1A-1C.

Also, while it is not shown in the figure, wire 11 is inserted such that it can move in the cylindrical upper wire guide arranged at the lower end of rotating part 12.

For a thermally sprayed film forming device with this configuration, thermal spraying gun 7 is inserted into cylinder bore 3 while being rotated, and spray 44 is directed towards inner surface 3*a* as the workpiece surface. As shown in FIG. 1A, thermally sprayed film 5 is formed. In this case, thermal spraying gun 7 is driven to make plural up/down reciprocal movement passes until thermally sprayed film 5 achieves a prescribed film thickness.

Figure 3:
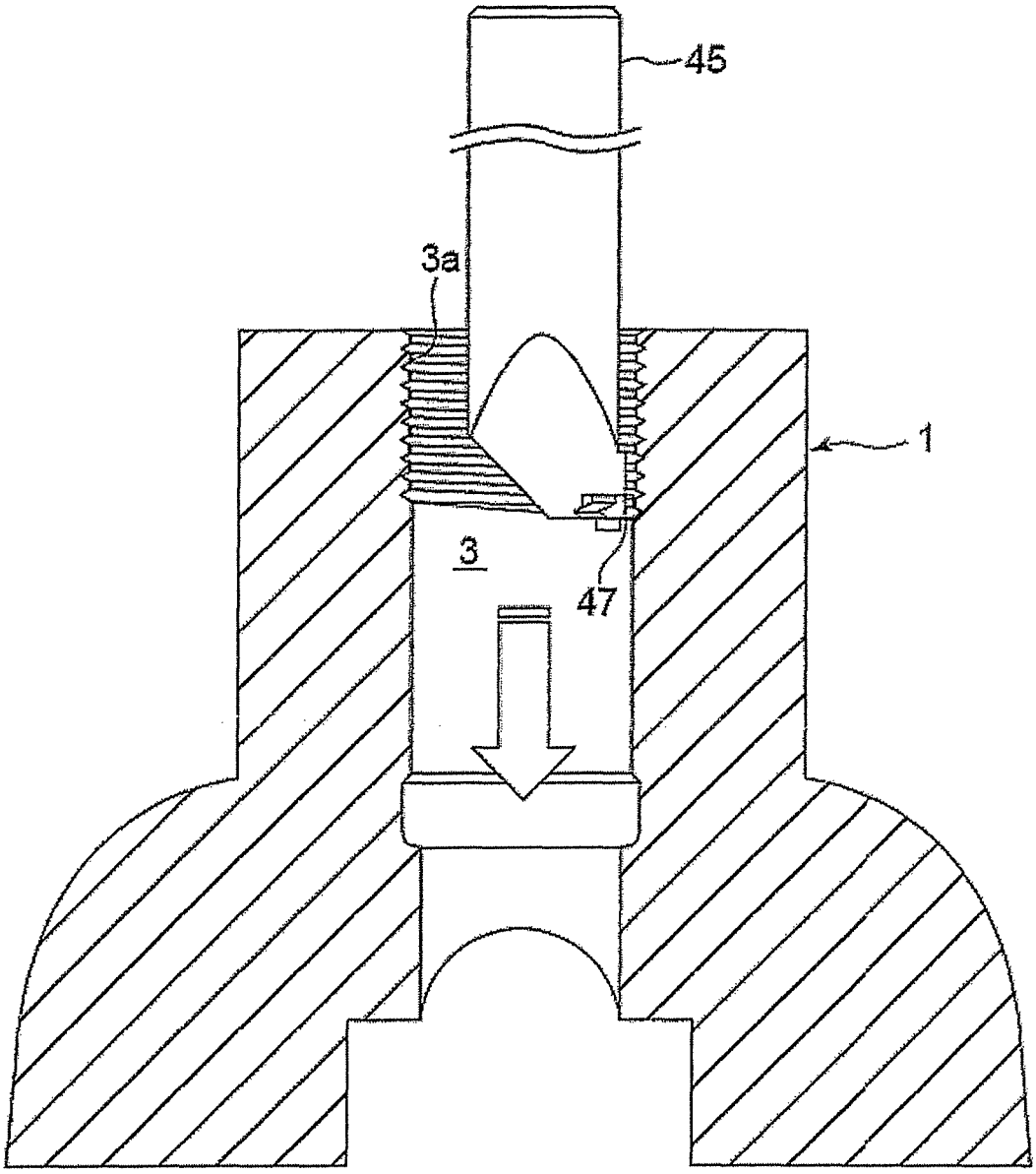
FIG. 3 is a cross section illustrating the state of preliminary treatment of the cylinder bore inner surface before formation of the thermally sprayed film.

Here, before thermally sprayed film 5 is formed, tool (blade) 47 is installed at the outer periphery of the tip of boring bar 45 of the boring processor as shown in FIG. 3 to improve the adhesion properties of thermally sprayed film 5 with respect to cylinder bore inner surface 3*a*. Boring bar 45 is driven to move downward in the axial direction as it is rotated, and inner surface 3*a* of cylinder bore 3 is given a threaded form.

In the process of forming thermally sprayed film 5 as explained above, and as shown in FIG. 1A, protrusions 49 are formed in the film layer from foreign objects (dust remaining from the preceding process steps, debris from films generated in the current process step, sputtered pieces, etc.) as nuclei that become attached to the thermal spraying substrate (cylinder bore inner surface 3*a*) or are mixed in with the film during thermal spraying.

Figure 4:
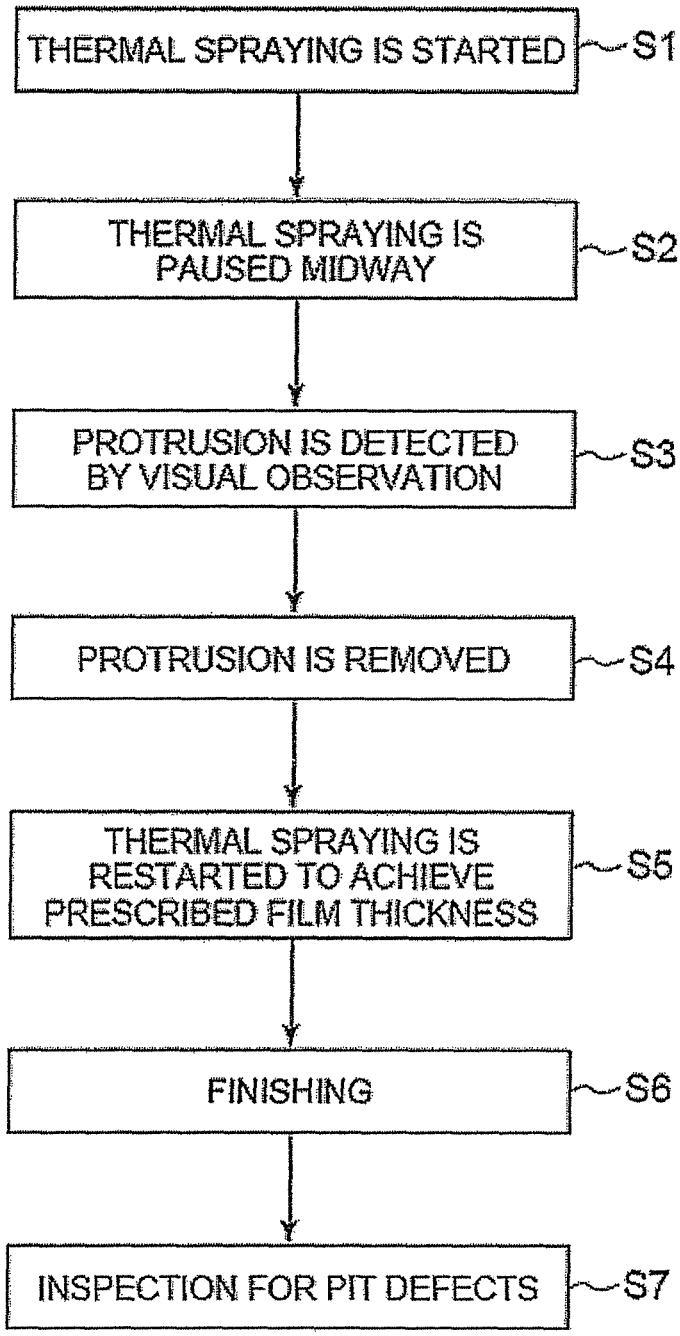
FIG. 4 is a flow chart illustrating the operation in the first embodiment.

Consequently, in the present embodiment, as shown in the processing flow chart in FIG. 4, after the start of thermal spraying (S1), thermal spraying is paused before thermally sprayed film 5 reaches the prescribed thickness (S2). For example, the pause time may come after sixteen (16) reciprocal movement passes when thermal spraying gun 7 must be driven to perform twenty (20) reciprocal movement passes to achieve the prescribed film thickness.

While the thermal spraying operation is paused as described, protrusions 49 are checked by visual observation (S3). When protrusions 49 are seen, protrusions 49 are removed in a manual operation using a chisel (chisel) or flathead screwdriver or other tool (S4).

After the removal of protrusions 49 as shown in FIG. 1B, the thermal spraying operation is re-started, and thermal spraying gun 7 is driven to perform the remaining four reciprocal movement passes so that thermally sprayed film 5 achieves the prescribed film thickness (S5). In this case, the portions where protrusions 49 have been removed are coated with the thermal spraying material so that the thin film there also reaches a film thickness similar to that prescribed.

Figure 5:
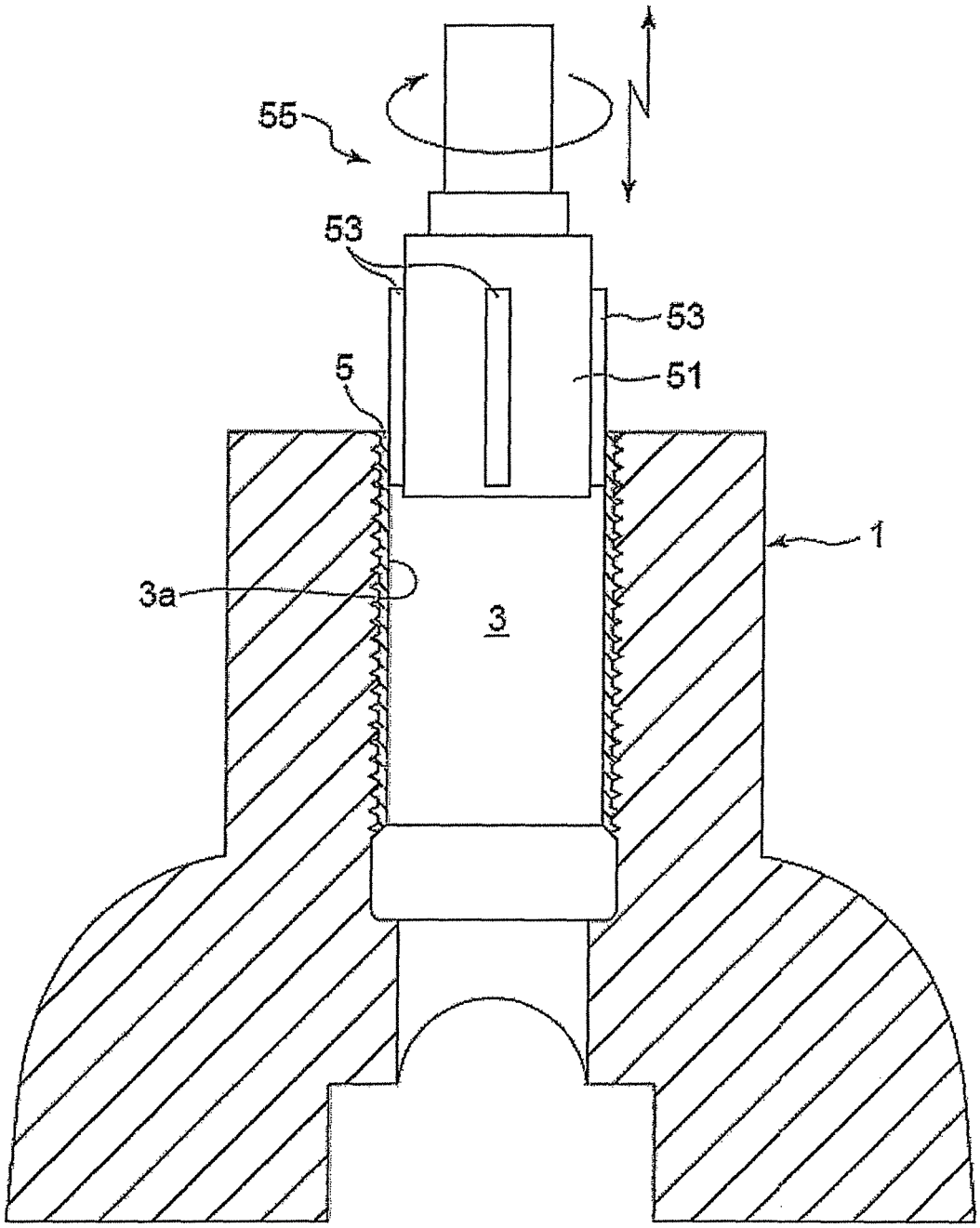
FIG. 5 is a cross section illustrating the state of finish processing after formation of the thermally sprayed film in the cylinder bore.

Then, as shown in FIG. 5, honing tool 55 equipped with grindstones 53 on the outer periphery of honing head 51 is rotated while being driven to perform reciprocal movements in the axial direction. In this manner, the surface of thermally sprayed film 5 is finish-ground (S6) to achieve the state shown in FIG. 1C.

At the sites where protrusions 49 were present on thermally sprayed film 5, the film thickness of thermally sprayed film 5 is a little thinner than the remaining portion, forming small recesses 57 as shown in FIG. 1B. Consequently, cutting in the honing processing is continued until these recesses 57 are removed. Finally, thermally sprayed film 5 is formed with the prescribed film thickness so that the bore inner diameter can be guaranteed.

As explained above, processing of inner surface 3*a* of cylinder bore 3 is completed, and a final inspection for defects is performed to determine whether pits have been generated in the surface of thermally sprayed film 5 (S7). Also, by changing the grain size of the grindstone during the honing process, rough processing and finish processing can be performed sequentially.

Also, an air discharge port (not shown) for measuring the inner diameter is present in the outer periphery of honing head 51. When honing is performed, air is discharged from the air discharge port, and the ejecting pressure is detected and converted to an electrical signal by an air micrometer. The inner diameter is measured by means of the air micrometer, and the honing process comes to an end when the measurement value reaches the prescribed value.

When finish processing is performed, protrusions 49 are removed beforehand, so that it is possible to prevent the generation of recesses (pits) due to protrusions 49 falling off, and it is possible to suppress the generation of defective products and to improve the yield.

According to this embodiment, protrusions 49 are detected by means of visual observation and are removed while the thermal spraying operation is paused, so that the operation for detecting and removing protrusions 49 can be performed reliably.

Also, by preventing the generation of pits, it is possible to prevent an increase in the oil consumption caused by an increase in the volume of the oil retained, while it is also possible to prevent spraying leaks of blow-by gas caused by deterioration in the sealing properties of the piston rings, to prevent separation of the thermally sprayed film caused by catching when the piston rings slide, to prevent deterioration in engine durability, and to prevent the problem of deterioration of commercial assets.

Because the foreign objects include protrusions 49 formed protruding on cylinder bore inner surface 3*a*, these protrusions 49 can be easily removed by means of a chisel, flathead screwdriver or other tool.

Figure 6:
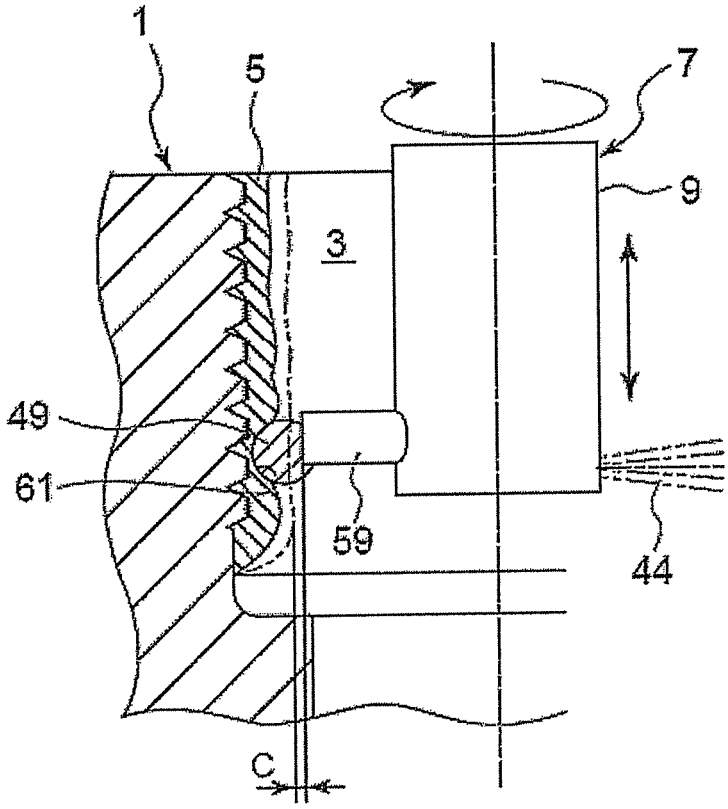
FIG. 6 is a diagram illustrating the protrusion removal operation in a second embodiment.

FIG. 6 is a diagram illustrating the operation of the thermally sprayed film forming method pertaining to a second embodiment of the invention. In this embodiment, according to the processing flow chart shown in FIG. 7, after the start of thermal spraying (S1), protrusions 49 are removed while the thermal spraying operation by thermal spraying gun (7) continues without stopping. The thermal spraying operation is continued until thermally sprayed film 5 achieves the prescribed film thickness (S10).

More specifically, as shown in FIG. 6, foreign object removal unit 59 is arranged projecting toward inner surface 3*a* of cylinder bore 3 on the side opposite from the discharge direction of spray 44 on the outer periphery of the tip of thermal spraying gun 7, in other words, at a position deviated by 180° in the circumferential direction from the discharge direction of spray 44.

For example, foreign object removal unit 59 may be a flat spring type of metal piece or tool (knife) 47 arranged on the outer periphery of the tip of boring bar 45 as shown in FIG. 3. Also, when thermal spraying gun 7 is inserted in cylinder bore 3 to perform thermal spraying, the tip of foreign object removal unit 59 is spaced apart from the surface of thermally sprayed film 5 that has reached the prescribed film thickness, and a clearance C of 150-200 μm is established between them.

Figure 7:
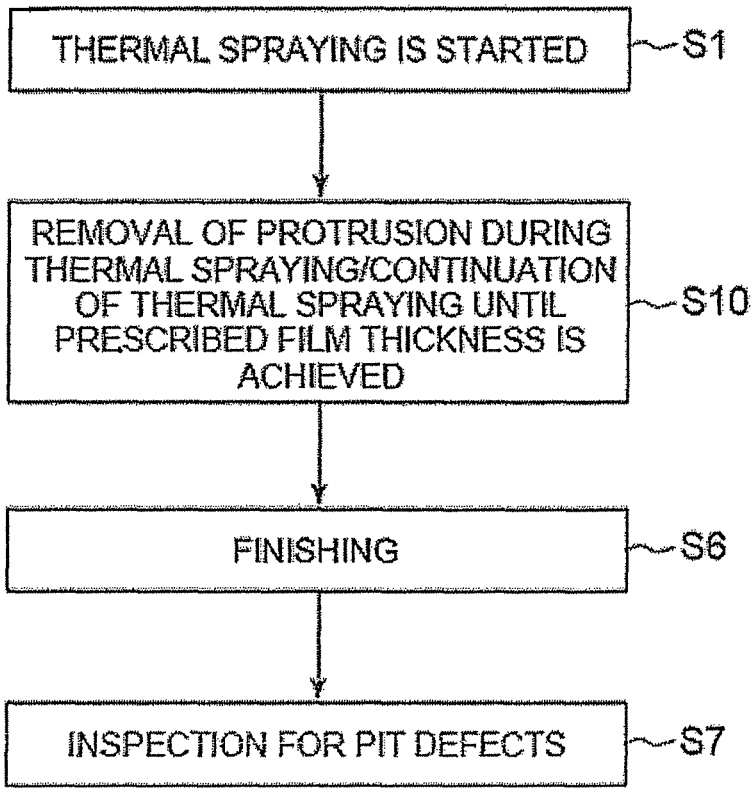
FIG. 7 is a flow chart illustrating the operation in the second embodiment.

In the second embodiment, as shown in the flow chart of FIG. 7, after the start of thermal spraying protrusions 49 are generated in the same way as those in the first embodiment. When protrusions 49 project beyond the surface indicated by the double-dot broken line of thermally sprayed film 5 with the prescribed film thickness, the tip of foreign object removal unit 59 set on the outer periphery of the rotating thermal spraying gun 7 contacts and scrapes off protrusions 49.

In this case, thermal spraying gun 7 is kept ON from the start of thermal spraying without pause, even after the removal of protrusions 49 thermal spraying is performed on inner surface 3*a* containing recesses 61 where protrusions 49 have been removed. In this manner, the overall thermally sprayed film 5 achieves the prescribed film thickness. In the second embodiment, thermal spraying gun 7 is driven to make twenty (20) reciprocal movement passes until thermally sprayed film 5 achieves the prescribed film thickness.

Then, just as in the first embodiment, after honing as the finish processing (S6), a check for defects is performed to determine whether pits have been generated in the surface of thermally sprayed film 5 (S7).

In this way, removal of protrusions 49 in the second embodiment is performed during a period of continuous thermal spraying, so that the yield can be higher than that in the first embodiment in which the thermal spraying operation is paused.

In this case, foreign object removal unit 59 in the present embodiment is mounted on the outer periphery of thermal spraying nozzle 9 as a foreign object removing means so that protrusions 49 can be removed easily while thermal spraying nozzle 9 is rotating and being driven in the axial direction to continue the thermal spraying operation.

In addition, in the present embodiment, the tip of foreign object removal unit 59 is set spaced apart from the surface of thermally sprayed film 5 while thermally sprayed film 5 achieves the prescribed film thickness, and unit 59 and film 5 do not contact each other. Consequently, it is possible to remove only protrusions 49 without affecting thermally sprayed film 5.

In this embodiment, because foreign object removal unit 59 is set on the side opposite from the discharge direction of spray 44 in thermal spraying gun 7, protrusions 49 removed during the thermal spraying operation are unlikely to mix into spray 44 discharged from the opposite side. Accordingly, it is possible to prevent the formation of secondary protrusions, caused by removed protrusions 49, in thermally sprayed film 5.

In the second embodiment, foreign object removal unit 59 is arranged integrally with thermal spraying gun 7. As another scheme that may be adopted, however, boring bar 45 shown in FIG. 3 can be used to mount such foreign object removing means separately from thermal spraying gun 7.

In this case, after thermal spraying gun 7 is used to perform the thermal spraying operation in the sixteen (16) reciprocal movement passes, thermal spraying gun 7 is pulled out of cylinder bore 3, and the foreign object removing means is inserted into cylinder bore 3 while being rotated. After removal of the foreign objects, the thermal spraying operation by thermal spraying gun 7 is restarted while the foreign object removing means is being pulled out from cylinder bore 3, and thermally sprayed film 5 achieves the prescribed film thickness.

Figure 8A:
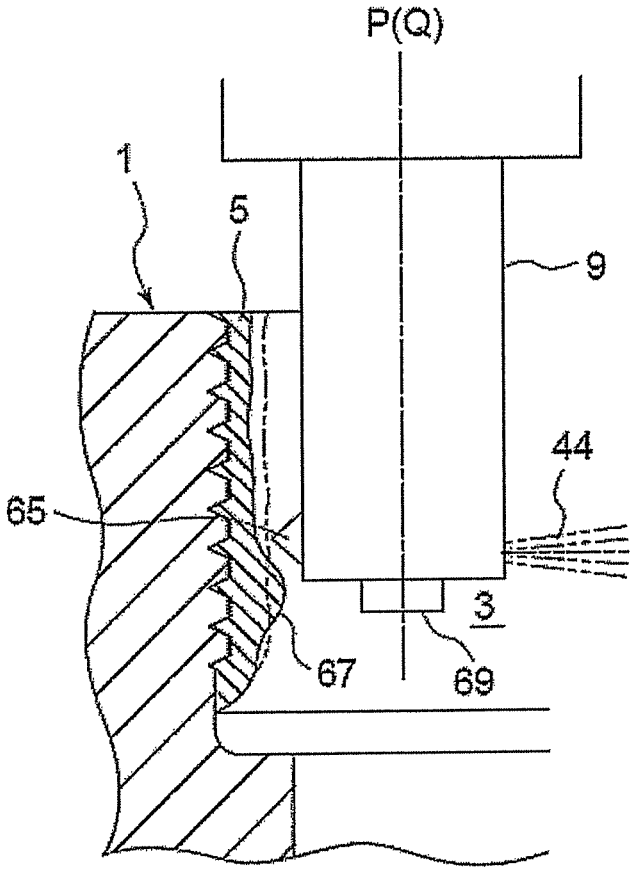
FIG. 8A is a diagram illustrating the operation of the thermally sprayed film forming method in a third embodiment.

FIG. 8A is a diagram illustrating the operation in the thermally sprayed film forming method in a third embodiment of the invention. In this embodiment, cutting tool 65 is attached on the outer periphery of the tip of thermal spraying nozzle 9 while laser sensor 69 is mounted on the tip surface for detecting protrusions 67.

Laser sensor 69 irradiates cylinder bore inner surface 3*a* with a laser beam, and the reflected light is received to detect the presence/absence of protrusions 67. The detection signal of laser sensor 69 is received by controller 25 shown in FIG. 2. Controller 25 controls driving of thermal spraying gun feed mechanism 26 based on the received signal and controls the travel speed in the axial direction of thermal spraying gun 7.

Figure 9:
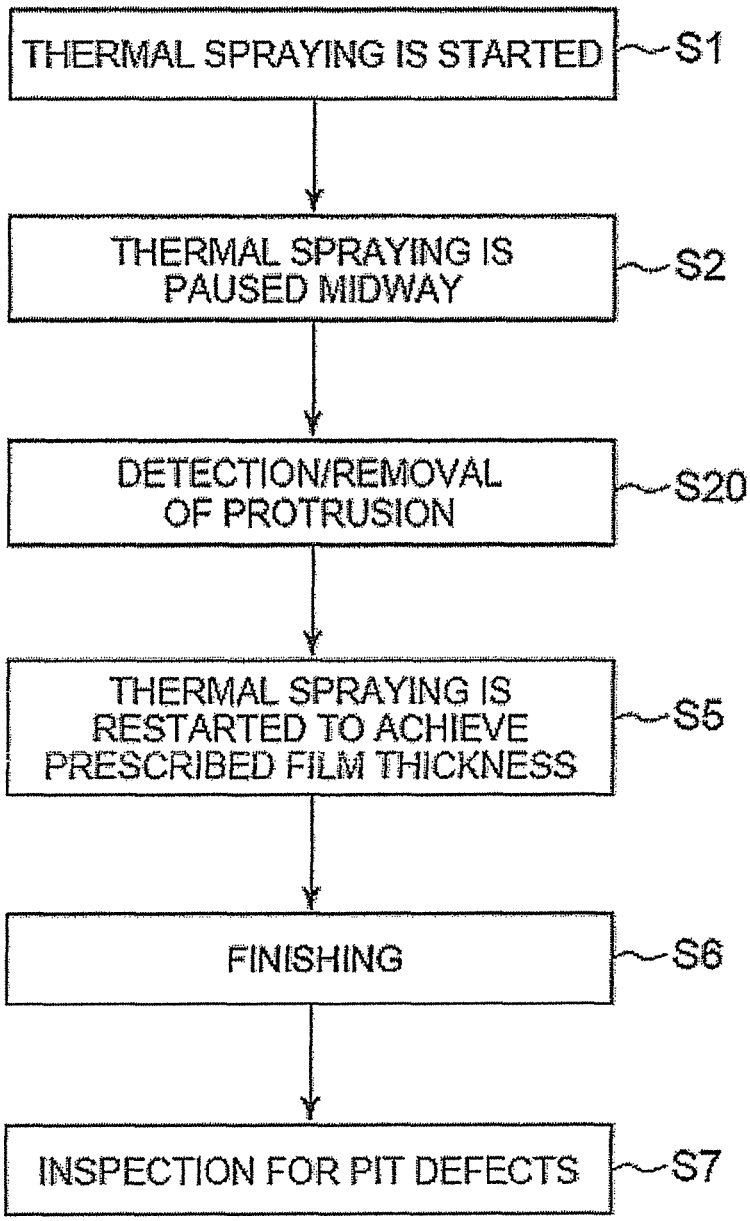
FIG. 9 is a flow chart illustrating the operation in the third embodiment.

As shown in the flow chart of FIG. 9, instead of step (S3) of detecting protrusions 49 by means of visual observation and step (S4) of removing protrusions in the first embodiment as shown in FIG. 4, in the third embodiment there is a process step (S20) of removing protrusions 67 by means of detecting/cutting tool 65 while utilizing laser sensor 69.

Figure 10:
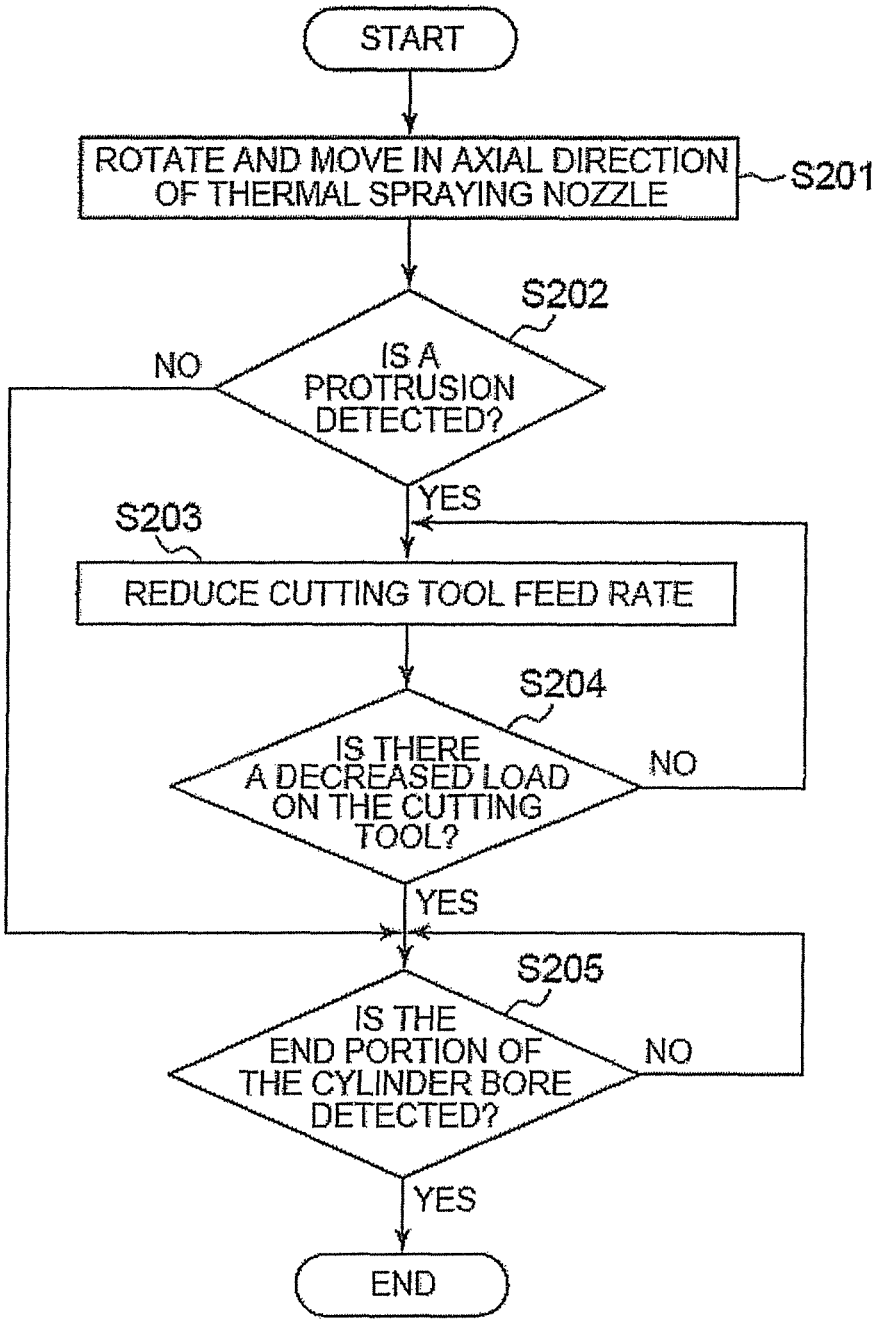
FIG. 10 is a flow chart illustrating the operation of detecting and removing protrusions in the third embodiment.

In the process step (S20) of detection/removal of protrusions 67, the process of control by controller 25 is that shown in the flow chart in FIG. 10. That is, after the formation of thermally sprayed film 5 by the thermally sprayed film forming device shown in FIG. 2, protrusions 67 are removed by cutting tool 65 shown in FIG. 8. In this case, thermal spraying nozzle 9 is inserted in cylinder bore 3 to move in the axial direction at a constant speed while rotating with its central axis Q aligned with central axis P of cylinder bore 3 (S201).

Figure 8B:
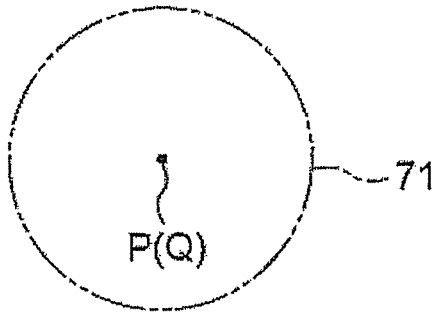
FIG. 8B is a diagram illustrating the rotation locus of the cutting tool when the thermal spraying nozzle is rotated in the third embodiment.

FIG. 8B is a diagram illustrating rotation locus 71 of cutting tool 65 when thermal spraying nozzle 9 is rotated. It has a circular shape centered on central axis P of cylinder bore 3.

In this case, the laser beam from laser sensor 69 irradiates cylinder bore inner surface 3*a*, and a judgment is made as to whether protrusions 67 are detected (S202). If protrusions 67 are detected, the travel speed of the overall thermal spraying gun 7 including thermal spraying nozzle 9, that is, the feed rate of cutting tool 65, is made lower than the feed rate before the detection of protrusions 67 (S203). In this case, the feed rate of cutting tool 65 is such that a heavy load is not applied to cutting tool 65, and protrusions 67 can be removed by cutting.

Then a judgment is made as to whether the load applied to cutting tool 65 is reduced by a prescribed quantity relative to that when protrusions 67 are cut (S204). Once removal of protrusions 67 is completed, the end portion of cylinder bore 3 is detected by laser sensor 69 (S205), and the operation of detecting protrusions 67 over the entire length in the axial direction of cylinder bore 3 is complete. The operation thus comes to an end.

On the other hand, if no protrusions 67 are detected in step S202, process flow goes to the operation of detecting end portion of cylinder bore 3 by means of laser sensor 69 in step S205.

Detection of the load applied to cutting tool 65 in step S204 may be performed by detecting the resistance to rotation of thermal spraying nozzle 9 by detecting the strain at an appropriate portion of thermal spraying nozzle 9. Also, a judgment as to whether removal of protrusions 67 has been completed may be performed by checking whether a prescribed time has elapsed instead of by detecting the load applied to cutting tool 65. That is, the time needed for removal of protrusions 67 is preset based on experience, and when this preset time has elapsed it is taken to signify that removal of protrusions 67 is complete.

After the detection and removal of protrusions 67, process flow returns to FIG. 9, and thermal spraying gun 7 is once again driven to move until thermally sprayed film 5 reaches the prescribed film thickness (S5). This is the same as the operation in the first embodiment.

In the third embodiment, when protrusions 67 are detected, the feed rate of thermal spraying nozzle 9 is lowered from the original level so that protrusions 67 are removed by means of cutting tool 65. Consequently, until protrusions 67 are detected the travel speed of thermal spraying gun 7 in the axial direction can be set as high as possible, and it is reduced only when protrusions 67 are being removed. As a result, it is possible to perform the operation of detecting and removing protrusions 67 with high efficiency.

In the third embodiment, before the process step of removing protrusions 67, thermal spraying gun 7 is driven to perform sixteen (16) reciprocal movement passes. Then, after the process step of removing protrusions 67, thermal spraying gun 7 is driven to complete four more reciprocal movement passes.

After the operation of removing protrusions 67, thermal spraying gun 7 is driven to move through at least one pass in one direction along cylinder bore 3 inner surface 3*a* while it sprays molten material.

That is, in this case, after thermal spraying gun 7 has been driven to move to the lowest end in FIG. SA and the operation for detecting protrusions 67 has been completed, thermal spraying gun 7 is at this point driven to make another pass of upward movement while the molten material is sprayed from thermal spraying nozzle 9. As a result, after the end of the for operation detecting protrusions 67, the operation of pulling out thermal spraying gun 7 from within cylinder bore 3 is exploited to form thermally sprayed film 5, and the operation can be performed with a very high efficiency.

In the third embodiment, the feed rate of cutting tool 65 is reduced. However, it is also possible to reduce the rotational speed of cutting tool 65 (thermal spraying nozzle 9), or to reduce both the feed rate and the rotational speed.

Figure 11A:
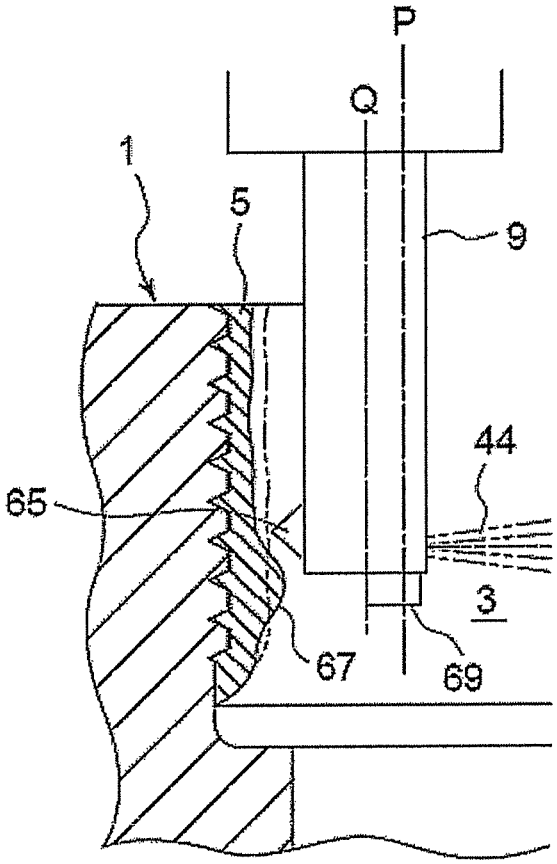
FIG. 11A is a diagram illustrating the operation of the thermally sprayed film forming method in a fourth embodiment.

FIG. 11A is a diagram illustrating the thermally sprayed film forming method pertaining to a fourth embodiment of the invention. In this embodiment, the diameter (size) of thermal spraying nozzle 9 is about half that in the third embodiment shown in FIG. 8. In addition, central axis Q of thermal spraying nozzle 9 is arranged offset with respect to central axis P of cylinder bore 3.

In this state, while thermal spraying nozzle 9 is rotated around its central axis Q, the entirety of thermal spraying gun 7 revolves around central axis P of cylinder bore 3. In this case, for example, the direction of rotation around central axis Q and the direction of revolution around central axis P in FIG. 11B are in the same clockwise direction, and the rotational speed around central axis Q is higher than the speed of revolution around central axis P.

In this embodiment, the mechanism for revolving the entire thermal spraying gun 7 is rather complicated. Consequently, cylinder block 1 may revolve around central axis P of cylinder bore 3 as the center. In this case, the revolving direction of cylinder block 1 is opposite to the direction of rotation around central axis Q as the center.

Figure 11B:
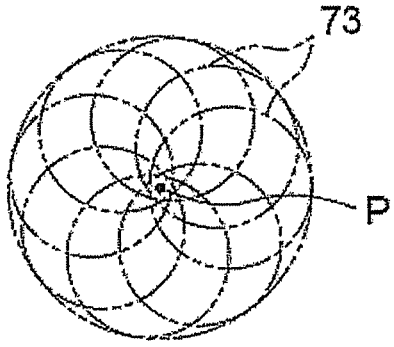
FIG. 11B is a diagram illustrating the rotation locus of the cutting tool when the thermal spraying nozzle is rotated in the fourth embodiment.

Consequently, as shown in FIG. 11B in this embodiment, the rotation locus of cutting tool 65 when thermal spraying nozzle 9 is rotated has a shape formed by revolution of the rotation locus 73 of cutting tool 65, which is performed around a central axis Q, around the central axis P of cylinder bore 3.

The operation of the fourth embodiment is the same as that of the third embodiment shown in FIG. 9, and the control operation of controller 25 in the operation for detecting and removing protrusions 67 in FIG. 9 is the same as that shown in the flow chart of FIG. 10.

In the fourth embodiment, however, thermal spraying nozzle 9 is driven to move slowly in the radial direction towards inner surface 3*a* of cylinder bore 3 while protrusions 67 are being ground and removed by cutting tool 65. Consequently, it is possible to remove protrusions 67 efficiently without applying a high load to cutting tool 65.

In addition, the outer diameter (size) of thermal spraying nozzle 9 is smaller in the fourth embodiment than in the third embodiment, and its central axis Q is offset with respect to central axis P of cylinder bore 3. Consequently, the structure can be adapted to various cases with different inner diameter dimensions for cylinder bore 3, so that the general applicability is excellent.

In these embodiments, the operation is not limited to that of the fourth embodiment shown in FIGS. 11A and 11B. A scheme can also be adopted in which thermal spraying gun 7 is not rotated while cylinder block 1 is driven to rotate around central axis P of cylinder bore 3 as the center, or thermal spraying gun 7 is not driven to move in the axial direction while cylinder block 1 is driven to move in the axial direction. That is, thermal spraying nozzle 9 can perform a relative rotation while making a relative movement along the axial direction with respect to cylinder bore 3.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. A thermally sprayed film forming method comprising:

linearly driving a spraying gun having a thermal spraying nozzle along a path of travel between an open first end and an opposing second end of an inner surface of a cylinder of a workpiece wherein said workpiece is a cylinder block of an engine, and said inner surface of said cylinder is a cylinder bore inner surface of the cylinder block; and applying a plurality of layers of the thermally sprayed film to the inner surface of the cylinder by rotationally spraying a molten material towards the inner surface of the cylinder from the thermal spraying nozzle while linearly driving the spraying gun and then allowing said molten material to solidify attached to said inner surface wherein, when all layers of the plurality of layers are applied, a prescribed film thickness of the plurality of layers is formed that is a total thickness of all layers of the plurality of layers, by:

after applying at least one layer of the plurality of layers and before applying all layers of the plurality of layers, removing a protrusion formed of a foreign object as a nucleus mixed in with the at least one layer of said thermally sprayed film attached to the inner surface of the cylinder by contact of a tip of a cutting device with the protrusion while the tip of the cutting device is spaced apart from the prescribed film thickness, the protrusion having a form such that it projects beyond an exposed surface of the applied at least one layer surrounding it and leaves a recess within the exposed surface of the applied at least one layer when removed; and applying remaining layers of all layers of the plurality of layers after removing the protrusion.

2. The method according to claim 1, further comprising:

pausing the linear driving of the spraying gun;

pausing the rotational spraying of the molten material towards the inner surface of the cylinder;

performing the removing of the protrusion while pausing the spraying and the linearly driving; and restarting the linearly driving and the rotational spraying of the molten material after removing the protrusion.

3. The method according to claim 2 wherein the linearly driving the spraying gun further comprises:

reciprocally driving the spraying gun through plural passes along the path of travel between the open first end and the opposing second end while spraying said molten material; and after removing the protrusion, driving the spraying gun to make at least one relative movement pass in one direction along the path of travel between the open first end and the opposing second end while spraying said molten material.

4. The method according to claim 1 wherein:

the cutting device is connected on an outer periphery of the thermal spraying nozzle, the cutting device extending from the thermal spraying nozzle to form the tip; and the method further comprising:

linearly driving the spraying gun at a linear movement speed and rotating the thermal spraying nozzle and foreign object removing device at a rotational speed to perform relative movement along the path of travel in the cylinder and to remove the protrusion by contact of the tip with the protrusion; and while removing the protrusion and while the thermal spraying nozzle remains continuously positioned in the cylinder between the open first end and the opposing second end, reducing at least one of the linear movement speed and the rotational speed of said thermal spraying nozzle and connected cutting tool device in comparison to speeds before and after removal of the protrusion.

5. The method according to claim 1, further comprising:

performing the removing of the protrusion while spraying said molten material.

6. The method according to claim 1, further comprising:

finish-processing a surface of said thermally sprayed film after all layers of said molten material forming said thermally sprayed film have been sprayed by honing the surface.

7. The method according to claim 6 wherein the form of the protrusion is such that, were it removed during honing, a pit would form in the surface.

8. The method according to claim 1, further comprising:

detecting the protrusion using a laser sensor attached to an outer periphery of the thermal spraying nozzle.

9. The method according to claim 8 wherein the cutting device extends from the thermal spraying nozzle to form the tip, the method further comprising:

responsive to detecting the protrusion using the laser sensor, reducing at least one of a movement speed and a rotational speed of the thermal spraying nozzle below that before detection of the protrusion while removing the protrusion with the tip of the cutting device.

10. The method according to claim 1 wherein the tip of the cutting device is spaced apart from the prescribed film thickness by a clearance distance of 150-200 microns.

* * * * *